US009631905B2

(12) United States Patent
Doria

(10) Patent No.: US 9,631,905 B2
(45) **Date of Patent: *Apr. 25, 2017**

(54) STATIONARY TARGET SHOOTING SYSTEM

(71) Applicant: Trilogy Targets Creations, Ltd., Oregon, OH (US)

(72) Inventor: Michael Doria, Oregon, OH (US)

(73) Assignee: Trilogy Targets Creations, Ltd., Oregon, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/086,209

(22) Filed: Mar. 31, 2016

(65) Prior Publication Data

US 2016/0238351 A1 Aug. 18, 2016

Related U.S. Application Data

(63) Continuation of application No. 14/475,788, filed on Sep. 3, 2014, now Pat. No. 9,303,959.

(60) Provisional application No. 61/876,351, filed on Sep. 11, 2013.

(51) Int. Cl.
*F41F 1/10* (2006.01)
*F41J 1/10* (2006.01)

(52) U.S. Cl.
CPC ..... *F41J 1/10* (2013.01)

(58) Field of Classification Search
CPC ..... F41J 1/10; F41J 7/04; F41J 3/0004; F41J 5/18; F41J 7/00; F41J 3/00; F41J 7/02
USPC ..... 273/390–392, 403–410
See application file for complete search history.

(56) References Cited

U.S. PATENT DOCUMENTS

| | | | | |
|---|---|---|---|---|
| 2,284,510 | A * | 5/1942 | Cates | F41J 7/06 273/406 |
| 2,372,111 | A * | 3/1945 | Norberg | F41J 1/10 160/201 |
| 3,355,174 | A * | 11/1967 | Hutson | F41J 1/10 248/156 |
| 3,647,214 | A | 3/1972 | Hohmann | |
| 4,726,593 | A | 2/1988 | Wade | |
| 4,884,658 | A | 12/1989 | Banfield | |
| 4,913,389 | A | 4/1990 | McCracken | |
| 5,263,721 | A | 11/1993 | Lowrance | |
| 5,342,062 | A | 8/1994 | Lance | |
| 5,865,440 | A | 2/1999 | Pulkrabek | |
| 7,052,012 | B2 | 5/2006 | Dehart | |
| 7,338,048 | B1 | 3/2008 | Hulstine | |

(Continued)

OTHER PUBLICATIONS http://adorama.com/LY4320000.
html?gclid=COKi7ceytLgCFSJqMgoda3sAzQ.

*Primary Examiner* — Mark Graham
(74) *Attorney, Agent, or Firm* — Ward Law Office LLC; Jacob M. Ward

(57) ABSTRACT

A stationary target shooting system includes a main body having a horizontal member, a vertical member, and a base. The horizontal member is coupled to a first end of the vertical member. The base is coupled to a second end of the vertical member. At least one paper target holder is disposed on the horizontal member. At least one non-paper target holder depends from the horizontal member. The stationary target shooting system is portable and can be easily broken down and reassembled for use on a variety of surfaces. The stationary target shooting system may be adapted for target shooting with both firearms and archery.

9 Claims, 4 Drawing Sheets

(56) References Cited

U.S. PATENT DOCUMENTS

| | | | |
|---|---|---|---|
| 9,303,959 | B2 | 4/2016 | Doria |
| 2006/0220318 | A1 | 10/2006 | Law |
| 2008/0272548 | A1 | 11/2008 | Hensley |
| 2013/0001880 | A1 | 1/2013 | Dean et al. |
| 2013/0147119 | A1 | 6/2013 | Matthis |

* cited by examiner

STATIONARY TARGET SHOOTING SYSTEM

CROSS-REFERENCE TO RELATED APPLICATIONS

This application is a continuation of U.S. patent application Ser. No. 14/475,788, filed on Sep. 3, 2014, which in turn claims the benefit of U.S. Provisional Application No. 61/876,351, filed on Sep. 11, 2013. The entire disclosures of the above applications are hereby incorporated herein by reference.

FIELD

The disclosure generally relates to target systems and, in particular, to a target system having multiple targets.

BACKGROUND

A multitude of different target shooting systems are known in the art. The details of these target shooting systems depend largely on the specific requirements or training practices of a shooter.

Targets used in the target shooting systems can range from paper targets to metal targets. These targets may be static, and are generally arranged at a distant end of a shooting range. Each of the targets can generally be moved around and positioned within the range depending on, for example, a particular training drill or practice need for a shooter.

There is a continuing need for a target shooting system that is portable, facilitates adjustments by a shooter to improve accuracy of a firearm or bow, and which may be assembled and used on a variety of ground surfaces.

SUMMARY

In concordance with the instant disclosure, a target shooting system that is portable, facilitates adjustments by a shooter to improve accuracy of a firearm or bow, and which may be assembled and used on a variety of ground surfaces, is surprisingly discovered.

In an illustrative embodiment, the disclosure includes a stationary target shooting system having a stand that holds a paper target and a non-paper target. The paper target may be placed within a generally U-shaped channel, which in turn is slid into a larger U-shaped channel that is attached to the stand. The non-paper target depends from the stand, for example, with a chain on a hook. In one embodiment, the non-paper target is a metal plate. In another embodiment, the non-paper target is an archery block. Where the archery block is used, a secondary tether or anchor attached to the bottom of the archery block may be driven into the ground to stabilize the archery block from swinging when used. Importantly, the center of the non-paper target is disposed on a same vertical axis as a center of the paper target. In operation, this allows a shooter to confirm the accuracy of a firearm prior to shooting the non-paper target.

In one embodiment, a stationary target shooting system includes a main body, at least one paper target holder, and at least one non-paper target. The main body has a horizontal member, a vertical member, and a base. The horizontal member is coupled to a first end of the vertical member. The base is coupled to a second end of the vertical member. The at least one paper target holder is disposed on the horizontal member. The at least one non-paper target depends from the horizontal member. The paper target holder and the non-paper target holder share a common vertical axis, which advantageously permits a honing of a shooter's accuracy by using the paper target prior to using the non-paper target.

In another embodiment, a stationary target shooting system includes a main body and at least one non-paper target. The main body has a horizontal member, a vertical member, and a base. The horizontal member is coupled to a first end of the vertical member. The base is coupled to a second end of the vertical member. The at least one non-paper target depends from the horizontal member. The non-paper target further has at least one anchor depending from the non-paper target. The at least one anchor is configured to connect the non-paper target to a ground surface. The at least one anchor advantageously stabilizes the position of the non-paper target, for example, an archery target block, in operation.

In a further embodiment, a stationary target shooting system includes a main body having a horizontal member, a vertical member, and a base. The horizontal member has one of at least one target holder and at least one target. The vertical member has a first end and a second end. The first end of the vertical member is coupled to the horizontal member. The base is coupled to the second end of the vertical member. The base has a plurality of legs that extend horizontally outward from the vertical member. The legs further have anchoring pins extending therefrom. The legs are rotatable to selectively present the anchoring pins in one of a first orientation pointed toward a ground surface, and a second orientation pointed away from the ground surface. This advantageously permits the stationary target shooting system to be used on a variety of ground surfaces, including soft surfaces such as soil and hard surfaces such as stone or pavement.

DRAWINGS

The above, as well as other advantages of the present disclosure, will become readily apparent to those skilled in the art from the following detailed description, particularly when considered in the light of the drawings described hereafter.

Figure 3:
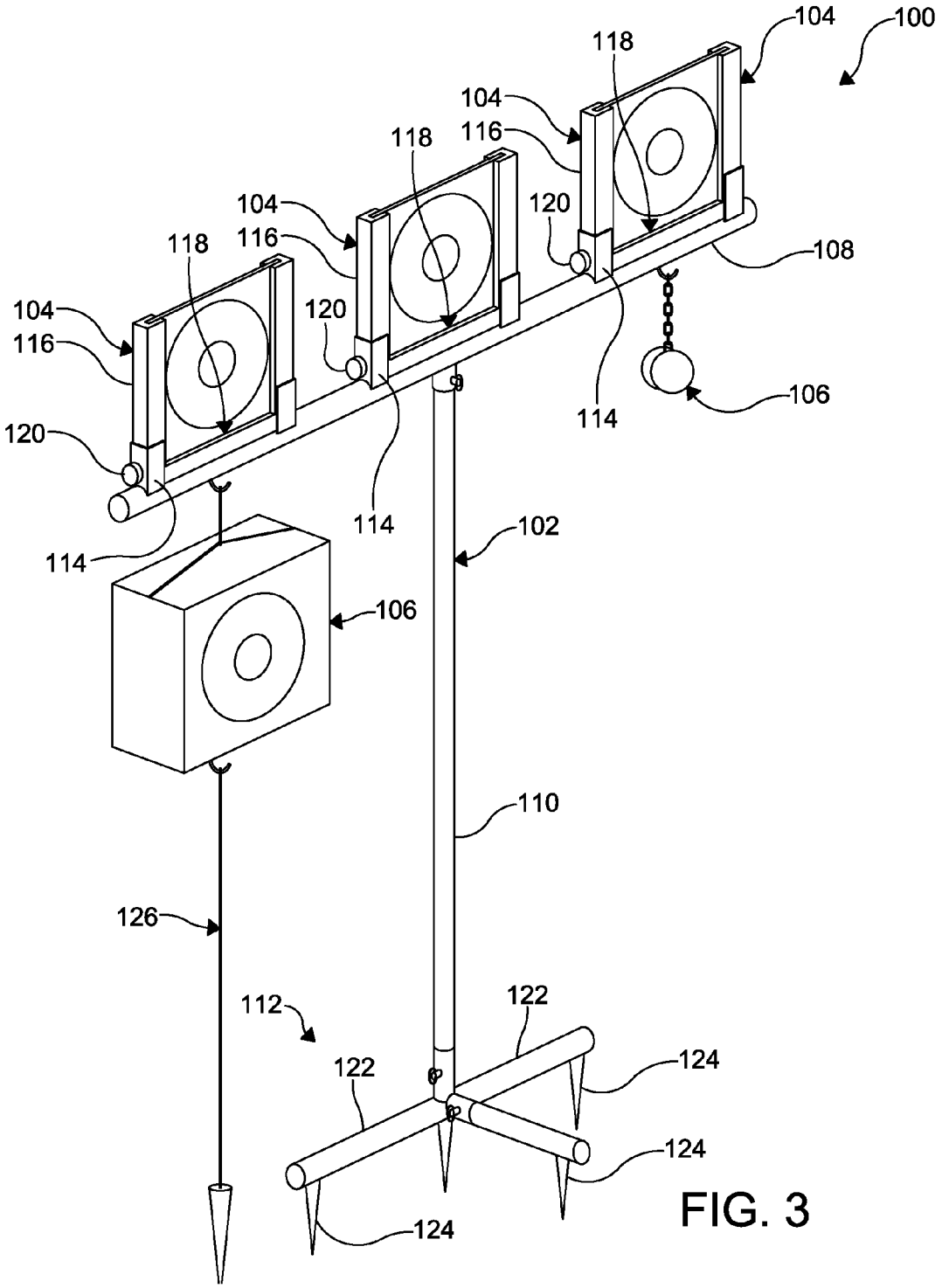
Figure 4:
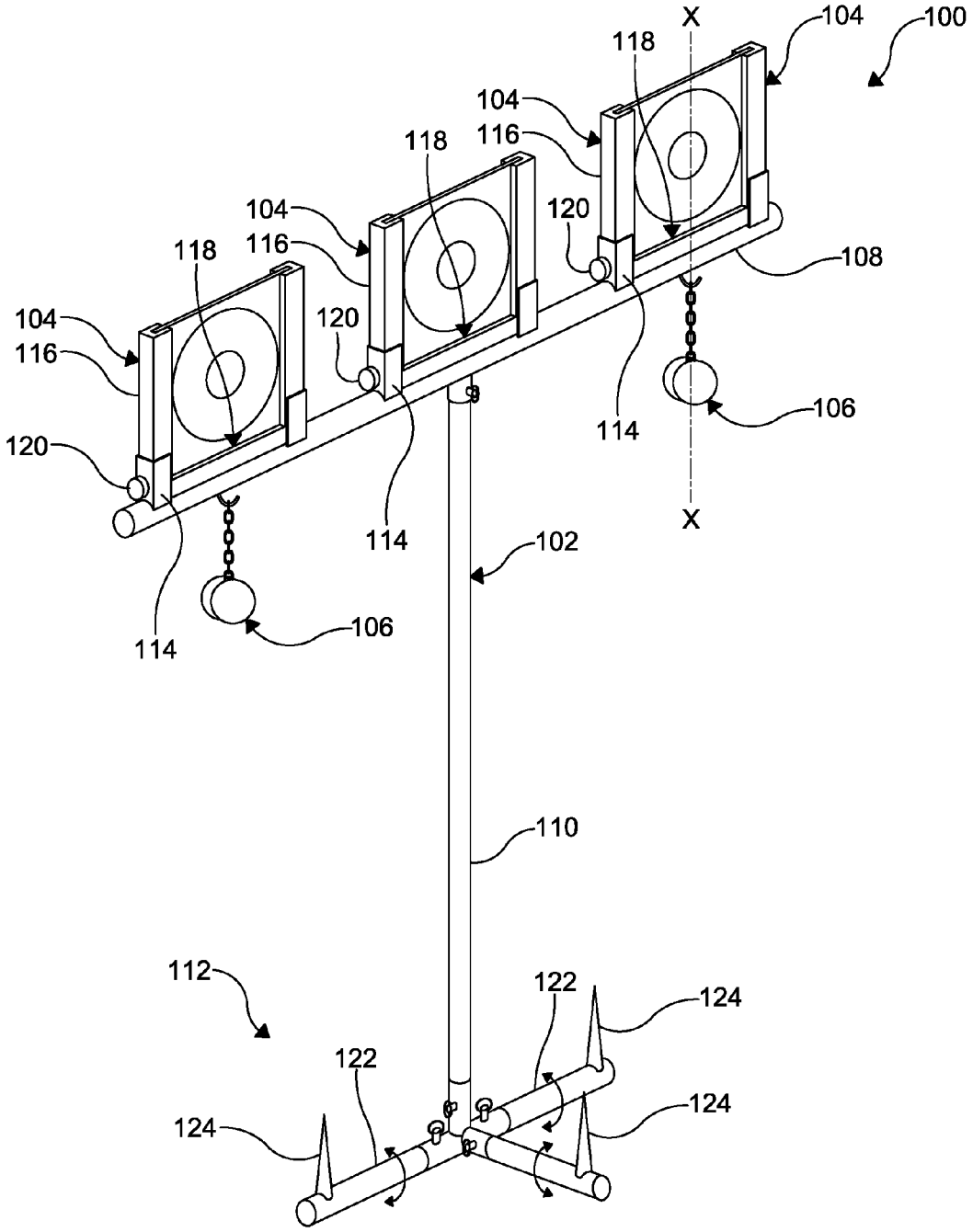

FIG. 3 is a front perspective view of a stationary target shooting system according to another embodiment of the present disclosure, the stationary target shooting system further having a hanging archery block target with stabilizing ground anchor system; and FIG. 4 is a front perspective view of a stationary target shooting system according to a further embodiment of the present disclosure, the stationary target shooting system having rotatable legs that permit the stationary target shooting system to be selectively anchored to or sit atop a ground surface.

DETAILED DESCRIPTION

The following description is merely exemplary in nature and is not intended to limit the present disclosure, application, or uses. It should also be understood that throughout the drawings, corresponding reference numerals indicate like or corresponding parts and features.

It should be understood that spatially relative terms, such as "vertical" and "horizontal" and the like, may be used herein for convenience in describing the relationship of certain elements or features to other elements or features. It will be understood that the spatially relative terms are intended to encompass different orientations of the system in use or operation in addition to the orientation depicted in FIGS. 1-4. For example, if the system in FIGS. 1-4 is turned over, elements described as "vertical" would then be oriented "horizontal". Thus, the exemplary terms "vertical" and "horizontal" can each encompass orientations of vertical, horizontal, and orientations therebetween, and the spatially relative descriptors used herein should be interpreted accordingly.

In FIGS. 1-4, a stationary target shooting system 100 according to one embodiment of the present disclosure is shown. The system 100 may include a main body 102, at least one paper target holder 104 and at least one non-paper target 106. The paper targets 105 used with the at least one paper target holder 104 may be of any suitable weight, density, and quality, and can include cardboard targets. The non-paper target 106 may be a metal disc, for example. In other embodiments, for example, as shown in FIG. 3, the non-paper target 106 is an archery target. One of ordinary skill in the art may select suitable types of paper targets 105 and non-paper targets 106 for use with the system 100, as desired.

The main body 102 includes a horizontal member 108, a vertical member 110, and a base 112. The horizontal member 108 is orientated in a manner substantially parallel to a ground surface when the system 100 is in operation. Although shown in FIGS. 1-4 as being a substantially linear piece, it should be appreciated that curved or irregularly shaped members that are otherwise oriented substantially parallel to the ground surface are also contemplated and may be used as the horizontal member 108, as desired. Likewise, more than one horizontal member 108 may be used within the scope of the present disclosure.

The vertical member 110 of the present disclosure is configured to hold the horizontal member 108 at a location above the ground surface, and spaced apart from the base 112. The vertical member 110 is oriented in a manner substantially transverse to the ground surface when the system 100 is in operation. Although shown in FIGS. 1-4 as being a substantially linear piece, it should be appreciated that curved or irregularly shaped members that are otherwise oriented substantially transverse to the ground surface are also contemplated and may be used as the vertical member 110, as desired. Likewise, more than one vertical member 110 for supporting the horizontal member 108 may be used within the scope of the present disclosure.

The at least one paper target holder 104 is disposed on the horizontal member 108. The at least on paper target holder 104 is configured to hold a paper target 105 as described hereinabove. The paper target 105 may have suitable target markings, for example, concentric circles, or other patterns that permit a user to determine an accuracy of a firearm or bow when the system 100 is used for practice.

The at least one non-paper target 106 depends from the horizontal member 108, for example, with a rope, chain, spring, or cord, connected to a hook on a base of the horizontal member 108. More than one rope, chain, spring, or cord may be used to suspend the non-paper target 106, as desired. Other means for allowing the non-paper target 106 to depend from the horizontal member 108 may also be employed within the scope of the disclosure.

Figure 1:
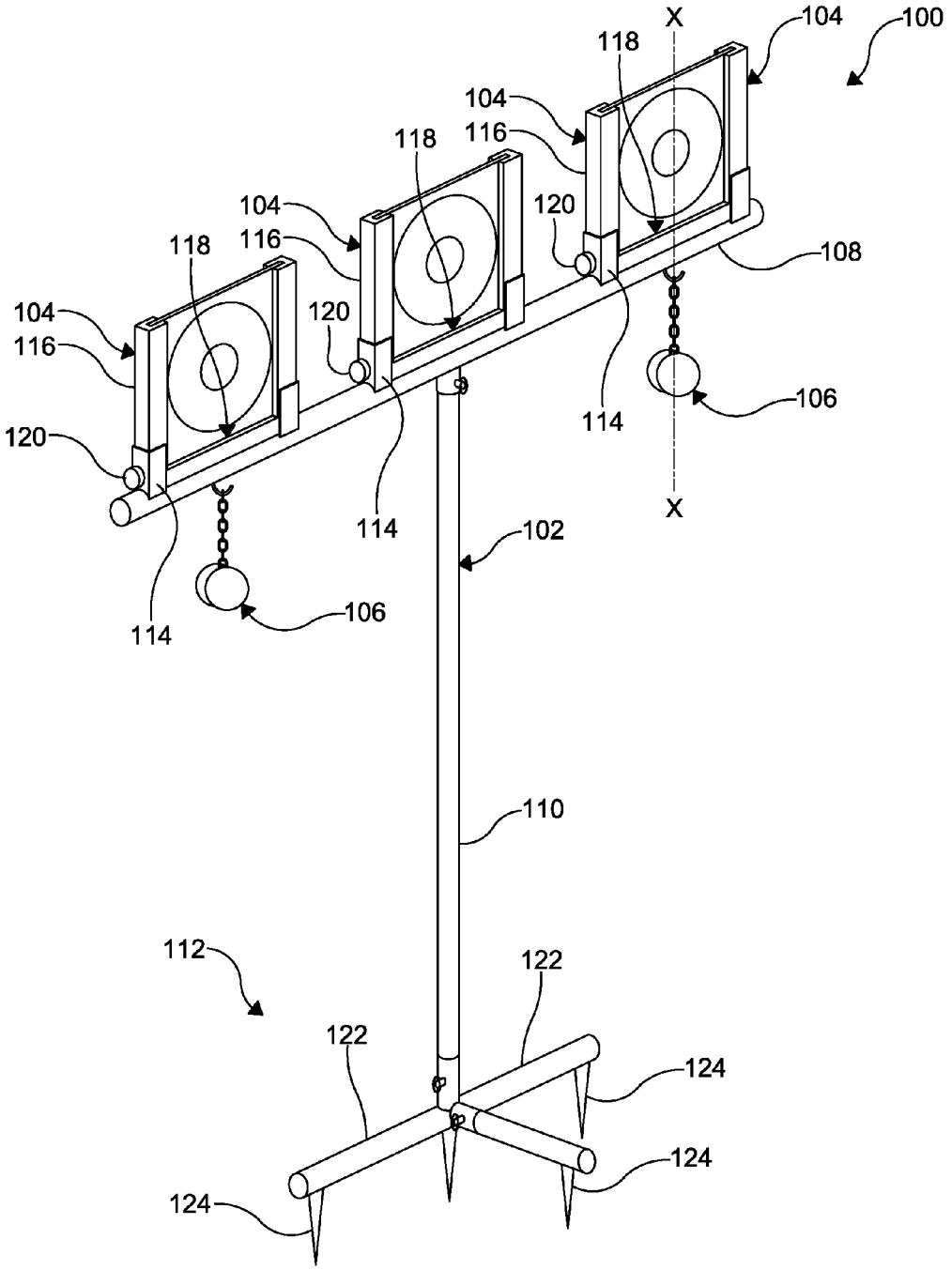
FIG. 1 is a front perspective view of a stationary target shooting system according to one embodiment of the present disclosure, the stationary target shooting system having paper and non-paper targets sharing a common vertical axis X-X, and a channel bracket receiving a U-shaped paper target holder.

As shown in FIG. 1, the paper target holder 104 with the paper target 105 and the non-paper target 106 may share a central, common vertical axis X. The non-paper target 106 is arranged along the common vertical axis X beneath the paper target 105, preferably with a horizontal center of each target 105, 106 being disposed on the same vertical axis X. Advantageously, the sharing of the common vertical axis X facilitates an accuracy evaluation of a firearm or bow using first the paper target 105, prior to shooting the non-paper target 106. It is also believed that this contributes to greater shooter satisfaction and enjoyment in the sport of shooting using the stationary target shooting system 100.

Figure 2:
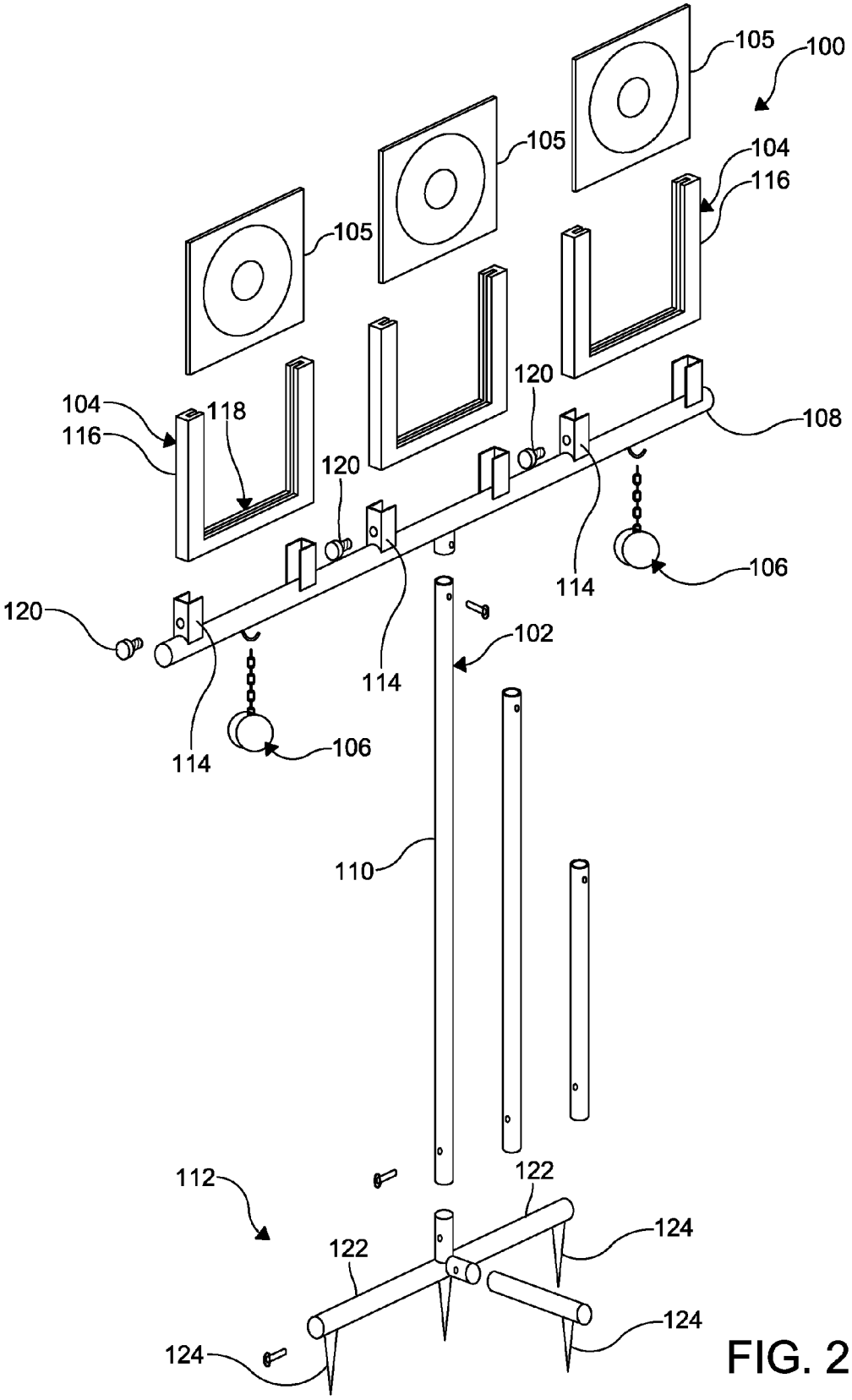
FIG. 2 is an exploded front perspective view of the stationary target shooting system shown in FIG. 1.

With reference to FIG. 2, the stationary target shooting system 100 is shown in a disassembled state, for example, to facilitate a transport or storage of the stationary target shooting system 100. In this regard, it should be understood that the system 100 may be provided in the form of a kit, that is, separate components that require assembly prior to use of the system 100. The kit may have a variety of interchangeable vertical members 110, each having a different length, to facilitate the assembly of the system 100 having different heights.

It should also be appreciated that the various components of the system 100 or kit may be separated and re-connected, for example, with push button release pins, pull pins or rods, screws, bolts, or the like cooperating with holes in the components, to facilitate the transport and the storage of the system 100. Other known means for connecting the various components to form the system 100 are also contemplated and within the scope of the disclosure.

In the particular embodiment shown in FIGS. 1-4, the at least one paper target holder 104 includes a channel bracket 114 and a substantially U-shaped body 116 having a channel 118. The U-shaped body 118 is configured to receive and hold the paper target 105 in the channel 118. The channel bracket 114 is coupled to the horizontal member 108 and is configured to receive and hold the U-shaped body 116.

In operation, the U-shaped body 116 may be removed from the channel bracket 114, and the paper target 105 loaded into the U-shaped body 116 so that it resides in the channel 118. The pager target holder 104, including the combined U-shaped body 116 and the paper target 105, is then inserted into the channel bracket 114 and secured in place for shooting.

In one example, best shown in FIGS. 1-2, the U-shaped body 118 is removably secured within the channel bracket 114 with a set screw 120. The set screw 120 may be disposed through a threaded hole formed adjacent a base of the channel bracket 114, for example. The set screw 120 may also have a knob attached thereto, which facilitates a tightening of the set screw by hand. Skilled artisans may also select other means for securing the U-shaped body 118 to the channel bracket 114, as desired.

As shown in FIGS. 1-4, the base 112 of the system 100 may have a plurality of legs 122. Each of the plurality of legs 122 extends horizontally outward from the vertical member 110. The legs 122 are configured to support the vertical member 110 in a substantially upright position when the based 112 is disposed on the ground surface. The legs 122 may be integral with the vertical member 110, or may be removably interconnected with the vertical member 110, as desired. For example, the legs 122 may be removably interconnected via the vertical member 110 with push button release pins or other means.

In a certain embodiment, best shown in FIG. 4, the legs 122 may be connected at a central body. The central body may have a plurality of receiving portions that each receives an end of one of the legs 122 or the vertical member 110. The central body and the legs 122 may also be tubular in shape, for example, to permit the legs 122 to be rotatable to different orientations as described further herein. The central body and the legs 122 may have concentrically aligned holes that permit an affixing of the central body and legs 122 at different rotatable positions, for example.

The legs 122 may further have anchoring pins 124 extending outwardly therefrom, at an orientation transverse to a longitudinal axis of each of the legs 122. The anchoring pins 124 facilitate the anchoring of the base 112 to the ground surface, to stabilize the system 100 for use in target shooting. The anchoring pins 124 may be substantially straight pins, pointed stakes, or have barbs or hooks to facilitate the anchoring to the ground surface, as desired. Other suitable types of the base 112, for example, plate- or stake-based configurations without legs, may also be employed within the scope of the present disclosure In a further embodiment, the legs 122 of the system 100 may also be rotatable to selectively present the anchoring pins 124 in one of a first orientation pointed toward a ground surface (shown in FIG. 1) and a second orientation pointed away from the ground surface (shown in FIG. 4), as desired. The legs 122 may each have holes formed at opposing positions in the ends of the legs 122 that are inserted into the central body, for example, which allow the legs 122 to be turned 180 degrees and then secured in place with push button release pins or other means. Advantageously, the selective rotation of the legs 122 to present the anchoring pins 124 in the first and second orientations allows the system 100 to be used both on soft ground, and also on hard surfaces such as concrete or asphalt.

In an alternative embodiment shown in FIG. 3, the non-paper target has at least one anchor 126 that depend from the non-paper target 106. The anchor 126 is configured to connect the non-paper target 106 to a ground surface, and thereby stabilize the non-paper target in operation. The anchor 126 can include a line such as a rope, chain, cord, etc. that is affixed to the non-paper target 106 at one end, and which has a stake affixed at another end. In operation, the stake may be inserted into the ground surface, so that the non-paper target 106 is firmly held in place by connections to both the horizontal member 108 and the ground surface. Advantageously, the anchor 126 may be used in cases where the non-paper target 106 is an archery target, such as a foam block or a sawdust-filled bag suitable for repeatedly receiving arrows and bolts. Like the non-paper target 106 illustrated in FIG. 1, the archery target with the anchor 126 may also be aligned along the common vertical axis X with the paper target holder 104.

The target shooting system 100 of the present disclosure is surprisingly portable, and may be readily broken down for transport or storage, and reassembled onsite where a shooter desires to practice. As established hereinabove, the system 100 facilitates adjustments by a shooter to improve accuracy of a firearm or bow, prior to making an attempt on the non-paper targets 106 of the system 100. The unique base 112 of the system 100 further allows the system 100 to be used on a variety of ground surfaces, allowing users to enjoy target practice in a multitude of different locations.

While certain representative embodiments and details have been shown for purposes of illustrating the invention, it will be apparent to those skilled in the art that various changes may be made without departing from the scope of the disclosure, which is further described in the following appended claims.

What is claimed is:

1. A stationary target shooting system, comprising:

a main body including a horizontal member, a vertical member, and a base, the horizontal member coupled to a first end of the vertical member at a longitudinal center of the horizontal member, and the base coupled to a second end of the vertical member;

a first paper target holder and a second paper target holder disposed on the horizontal member, the first paper target holder and the second paper target holder each including a channel bracket and a body having a channel, the body removably secured within the channel bracket and configured to receive and hold a paper target in the channel in an upright position, wherein the first paper target holder and the vertical member share a same vertical axis, and the second paper target holder is horizontally offset from the same vertical axis shared by the first paper target holder and the vertical member; and a non-paper target depending from the horizontal member, wherein the second paper target holder and the non-paper target holder share a common vertical axis.

2. The stationary target shooting system of claim 1, wherein the body having the channel is substantially U-shaped.

3. The stationary target shooting system of claim 2, wherein the channel bracket is coupled to an upper surface of the horizontal member and is configured to receive and hold the U-shaped body.

4. The stationary target shooting system of claim 3, wherein the U-shaped body is removably secured within the channel bracket with a set screw disposed through a threaded hole in the channel bracket and selectively contacting the U-shaped body.

5. The stationary target shooting system of claim 1, wherein the non-paper target has at least one anchor depending from the non-paper target and configured to connect the non-paper target to a ground surface and stabilize the non-paper target in operation.

6. The stationary target shooting system of claim 5, wherein the non-paper target is an archery block.

7. The stationary target shooting system of claim 1, wherein the base includes a plurality of legs extending horizontally outward from the vertical member.

8. The stationary target shooting system of claim 7, wherein the legs have anchoring pins extending therefrom.

9. The stationary target shooting system of claim 8, wherein the legs are rotatable to selectively present the anchoring pins in one of a first orientation pointed toward a ground surface and a second orientation pointed away from the ground surface.

* * * * *